United States Patent [19]

Young

[11] Patent Number: 4,984,758

[45] Date of Patent: Jan. 15, 1991

[54] SCRAP CATCHER

[76] Inventor: Diane P. Young, 3627 Clear Falls, Kingwood, Tex. 77339

[21] Appl. No.: 343,151

[22] Filed: Apr. 25, 1989

[51] Int. Cl.[5] ..... B65B 67/00

[52] U.S. Cl. ..... 248/95; 248/101

[58] Field of Search ..... 248/95, 99, 101, 100, 248/97, 98

[56] References Cited

U.S. PATENT DOCUMENTS

| | | | |
|---|---|---|---|
| 1,431,726 | 10/1922 | Cupples | 248/95 |
| 1,637,131 | 7/1927 | Rigby | 248/95 |
| 2,637,918 | 5/1953 | Mayhew | 248/99 X |
| 2,660,496 | 11/1953 | Lake | 248/95 X |
| 3,386,444 | 6/1968 | Brenner et al. | 248/99 X |
| 3,794,280 | 2/1974 | Atkin | 248/99 |
| 4,411,300 | 10/1983 | Rico | 248/99 X |

FOREIGN PATENT DOCUMENTS

| | | | |
|---|---|---|---|
| 1295465 | 5/1969 | Fed. Rep. of Germany | 248/99 |

OTHER PUBLICATIONS

"Serger-Catch-It", Sew News, May 1988.

"Give Your Serger A Catheter", Sew News, Aug. 1988.

*Primary Examiner*—David L. Talbott

*Attorney, Agent, or Firm*—Donald J. Verplancken; David A. Rose; Ned L. Conley

[57] ABSTRACT

A scrap catcher provides a hard work table for the placement of a serger thereon, a resilient pad thereunder to absorb vibration and noise from the serger, and, an aperture for removably receiving a bag to catch and store the serger fabric scrap.

11 Claims, 1 Drawing Sheet

SCRAP CATCHER

BACKGROUND OF THE INVENTION

This invention relates to the field of sewing, more particularly to sewing machines, and more particularly to sewing machine accessories.

A sewing machine known as a serger simultaneously sews and trims a seam between two or more pieces of fabric. The serger typically has a T-shaped based which forms a work surface for aligning and feeding the materials to be sewn under the sewing and trimming head. The main body, or cabinet, of the serger, which includes the mechanical componentry which reciprocates the sewing needle and actuates the cutting head, is located over the upright portion of the T. The sewing head overhangs the intersection of the upright and crossbar portions of the T, and the top of the crossbar forms a table for feeding and aligning the fabric under the sewing and cutting head. Alternatively, the base may be in the shape of an L, and the serger cabinet locates over the upright portion of the L, and the base of the L forms a table for feeding and aligning the fabric and on the sewing and cutting head.

During operation, the serger operator feeds the material to be sewn under the sewing head, and the head stitches a seam and cuts away any scrap which overhangs or interferes with the seam. The scrap exits the sewing head at the intersection of the crossbar and upright, and falls over the side of the serger base to the table or floor below. The scrap may take the form of long thin lengths of material, or may exit the serger as smaller pieces of fabric.

The loose scrap is commonly of a size which is easily ingested by infants and pets, which is potentially dangerous. The scrap could cause choking when ingested, or could contain toxic elements which could poison children or pets. The scrap can also be a nuisance when it reaches the floor, because the elderly or infirm may have difficulty bending down to pick it off of the floor. Further, it may tend to jam in the heads of some vacuum cleaners or floor sweepers.

SUMMARY OF THE INVENTION

The present invention is a serger scrap catcher in the form of a mounting base for receiving a serger thereon, and a removable bag for receiving and retaining serger scrap for easy disposal. The mounting base includes a resilient non-stick pad mounted therein, and an aperture therethrough for mounting the scrap catcher bag. An interference flange is disposed in the aperture, and the upper wall of the bag is disposed between the flange and aperture.

The scrap catcher of the present invention provides an easily accessible scrap retaining bag for efficient disposal of scrap. This, and other advantages of the invention, will become apparent upon review of the description of the preferred embodiment, when read in conjunction with the following drawings, wherein:

DESCRIPTION OF THE PREFERRED EMBODIMENT

Figure 1:
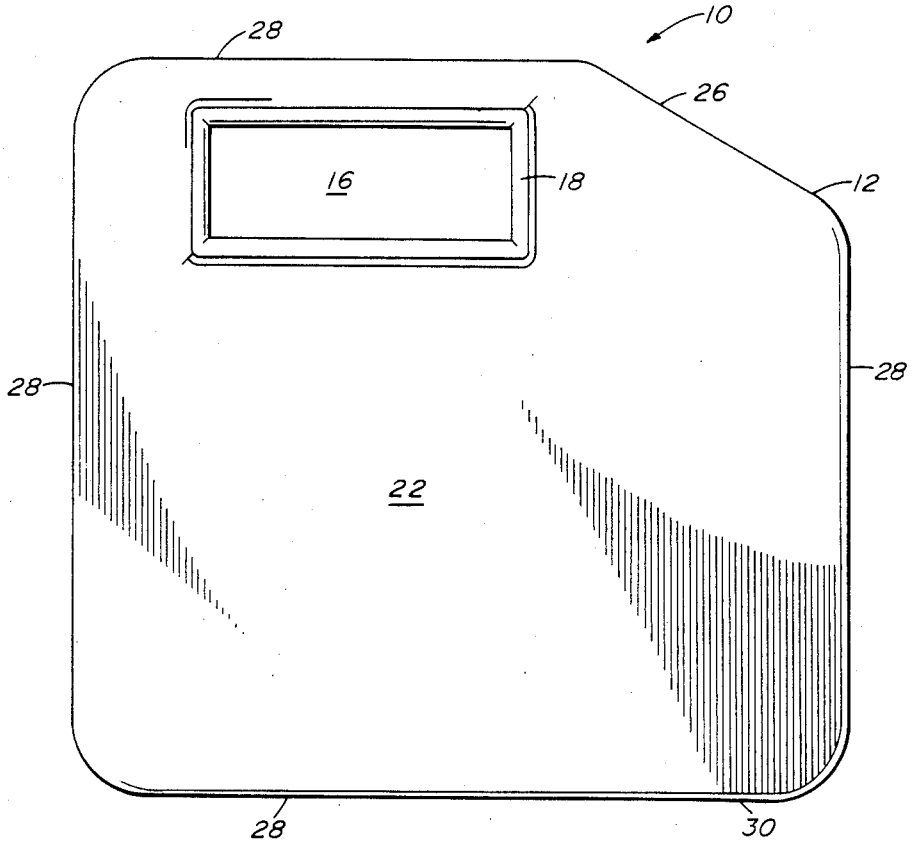
FIG. 1 is a top view of the scrap catcher of the present invention.
Figure 2:
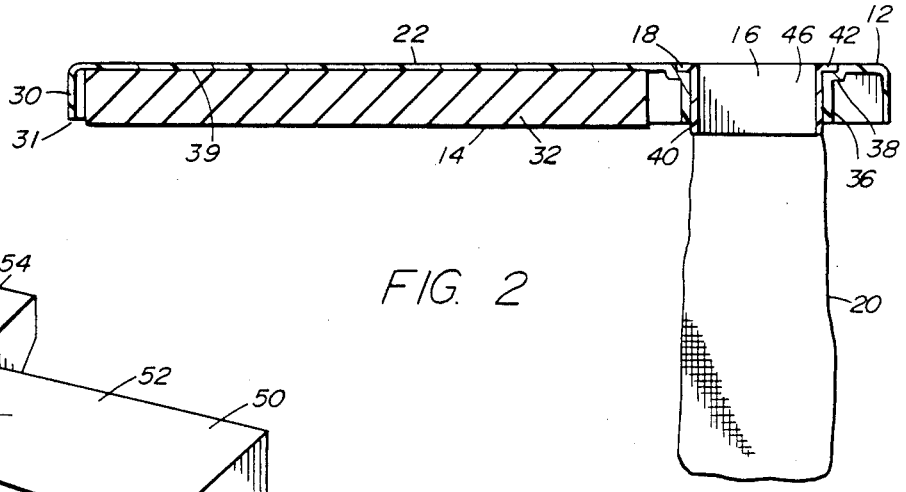
FIG. 2 is a cutaway view of the scrap catcher of FIG. 1 at section 2—2.

Referring to FIGS. 1 and 2, the scrap catcher 10 of the present invention includes a base 12 having a resilient pad 14 mounted thereon, and an aperture 16 having an interference flange 18 therein for releasably holding bag 20 on base 12.

Base 12 is a generally flat five-sided planar section 22 having rounded corners 24 and aperture 16 located therethrough. Planar section 22 is generally rectangular, having a chamfered edge 26 between two of sides 28 forming a fifth side. Sides 28 and edge 26 form a continuous perimeter wall 30 which projects downward from planar section 22 terminating in a support edge 31 which supports planar section 22 off of a table or other surface. Perimeter wall 30 and planar section 22 cooperate to form pad recess 32 for retaining pad 14 as will be further described herein. Perimeter wall 30 and planar section 22 are preferably formed as one continuous piece of vacuum formed ABS plastic, approximately 0.125 inches thick. The outer face of planar section 22 has a textured surface. Although ABS is the preferred planar section 22 and perimeter wall 30 material, other materials having sufficient strength to support planar section 22 and perimeter wall 30 from excessive deformation when a load such as a serger is placed thereon may be substituted in its place.

Referring now to FIG. 2, pad 14 is disposed on the underside of planar section 22 in pad recess 32. Pad 14 is a section of a conformable material, preferably a closed cell foam such as S B R E P D M, which will compress when scrap catcher 10 is placed on a flat area, such as a table top and a load is placed upon planar section 22. Pad 14 projects outward from pad recess 32 past edge 31, preferably 1/16 to ⅛ of an inch outward therefrom. When scrap catcher 10 is placed on a flat surface, pad 14 helps anchor scrap catcher 10 against lateral movement by the action of the frictional force between the conforming outer surface of pad 14 and the flat surface on which catcher 10 is located. Pad 14 also absorbs vibrations and noise emitted from the serger during operation. Thus, pad 14 provides lateral stability which helps prevent vibration—a motion of the base 12 during serger operation. As greater weight or force is placed against planar section 22, pad 14 will compress until edge 31 contacts the flat surface, at which point both pad 14 and perimeter wall 30 support planar section 22 and the weight or force thereon.

Pad 14 is attached to the underside of planar section 22 with an adhesive 34, preferably a pressure sensitive adhesive attached to pad 14. Pad 14, with the adhesive area exposed, is pressed against the underside of the planar section 22, and the adhesive 34 will bind pad 14 thereto. Although pad 14 may be placed over the entire underside of planar section 22, except that area adjacent and within aperture 16, pad 14 is preferably disposed only in the portion of pad recess 32 over which the serger will be placed, which is further described herein.

Referring again to FIGS. 1 and 2, aperture 16 is a rectangular section having flange 18 and bag 20 retained therein. Aperture 16 is bounded by aperture wall 36, which is a wall projecting downward from planar section 22 having a rectangular perimeter. A flange recess 38, in the form of a right-angled lip, is disposed between planar section 22 and aperture wall 36. Flange recess 38 is recessed in planar section 22 a slightly greater distance than the thickness of planar section 22.

Flange 18 is a generally rectangular section of vacuum formed ABS having an interference wall 40 and an outward projecting hanger lip 42 disposed in perpendicular relationship to each other. Hanger lip 42 rides on flange recess 38, and preferably has the same thickness as planar section 22. As flange recess 38 is slightly greater than planar section 22 thickness, hanger lip 42 will not project above planar section 22. Interference wall 40 includes an outer perimeter which is approximately the same dimension as the perimeter of aperture wall 36. Therefore, when flange 18 is pressed into aperture 16, flange 18 will undergo very slight deformation which then exerts an outward force to maintain flange 18 in place in aperture 16.

Bag 20 is a polyethylene walled, gusseted bag having a thickness of approximately 0.00125 inches. Bag open end 46 is sized to receive flange 18 therein, and flange 18 and bag 20 are inserted through aperture 16 such that the bottom of bag 20 projects outward past pad 14 and the wall of bag 20 is interferingly retained between aperture wall 36 and perimeter wall 40. When flange 18 is fully inserted into aperture 16, lip 42 abuts flange recess 38 such that flange 18 is held below the surface of planar section 22, and the spring force of the slightly deformed flange 18 maintains flange 18 and bay 20 in place. Interference between bag 20, aperture 16 and flange 18 maintains bag 20 in place in aperture, even if sewing scrap fills bag 20.

It should be appreciated that the present invention permits fabric scraps to be quickly swept, by hand or the like, to the aperture 16 where they will fall into bag 20. Bag 20 is easily removed and replaced by removing flange 18, pulling out full bag 20, inserting new bag 20 into aperture 16, and then placing flange 18 into the open end of bag 20 and then back into aperture 18.

Figure 3:
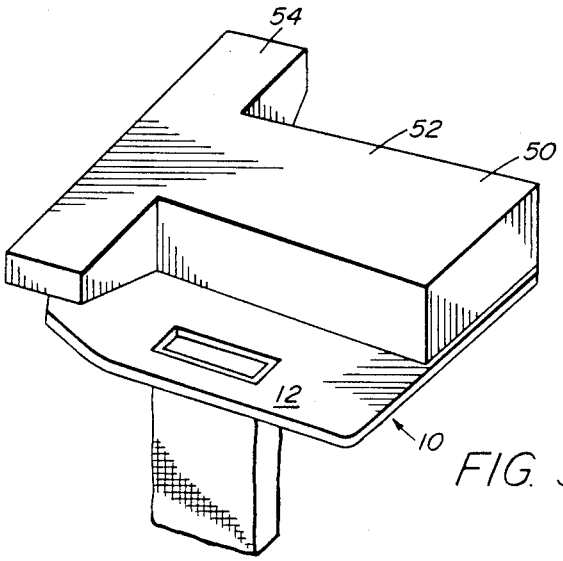
FIG. 3 is a perspective view of scrap catcher of the FIG. 1.

Referring now to FIG. 3, a serger base 50 is shown disposed on scrap catcher 10 on planar section 22. Base 50 typically has a T-shaped cross section having stem portion 52 and crossbar portion 54. Base 50 is placed on planar section 22 such that stem portion 52 is adjacent the long side of aperture 16, and crossbar portion 54 is disposed adjacent the short side of aperture 16 and overhangs chamfer 24. A sewing and cutting head will locate at the intersection of stem portion 52 and crossbar portion 54. Material is fed along the top of crossbar portion 54, and scrap will fall over the side thereof and onto planar section 22 or into bag 20 in aperture 16. Crossbar portion 54 of base 50 is upwardly tapered from stem portion 52, and therefore stem portion 52 bears the entire weight of the serger. Thus, pad 14 need only be located in pad recess 32 adjacent only that portion of planar section 22 over which stem portion 52 is disposed. Scrap catcher 10 is sized so that the distance between aperture 16 and wall 26 over which base 50 is located is only slightly larger than stem portion 52.

Although a preferred embodiment of the invention has been shown and described, those skilled in the art will appreciate that modifications may be made thereto without deviating from the scope of the invention.

I claim:

1. A fabric scrap disposal system comprising:

a mounting base having a generally flat upper surface;

an aperture disposed through said mounting base;

a bag disposed through said aperture having its open end disposed adjacent and below said mounting base flat upper surface;

a flanged retainer mounted within said aperture such that said open end of said bag is disposed between said retainer and said aperture;

said bag open end received and supported between said retainer and said aperture, such that said retainer is received in the interior of said bag; and said flanged retainer including a lip portion not extending above the upper surface of said mounting base.

2. The fabric scrap disposal system of claim 1, wherein said aperture has a downwardly projecting wall about its perimeter.

3. The fabric scrap disposal system of claim 2, wherein said retainer has a wall portion which presses against said projecting wall to retain said bag in said aperture.

4. The fabric scrap disposal system of claim 1 wherein said base is located over a resilient pad.

5. The fabric scrap disposal system of claim 4 wherein said resilient pad is manufactured from EPDM.

6. The fabric scrap disposal system of claim 1 wherein said base has a downwardly projecting perimeter wall.

7. The fabric scrap disposal system of claim 6 wherein a resilient pad is disposed against the bottom of said base and extends outward beyond said perimeter wall.

8. The fabric scrap disposal system of claim 7 wherein said pad is affixed to said base with a pressure sensitive adhesive.

9. A sewing scrap retainer and disposal unit for use with a serger, comprising;

a generally flat conformable base having a downwardly projecting unitary perimeter wall portion;

an aperture disposed through said base, including a downwardly projecting aperture wall interconnected to said base through a flange recess portion;

a bag having an open end forming the perimeter of a bag opening, said open end projecting into said aperture adjacent said aperture wall and flange recess portion;

a flange having an interference wall conforming to said aperture perimeter, and including a hanger lip thereon projecting perpendicular to said interference wall, said flange received within said bag open end;

said flange recess having an offset from said base greater than the thickness of said hanger lip; and said flange received in said aperture to secure said open end of said bag in said aperture below said hanger lip, said interference wall interferingly engaging said bag open end against said downwardly projecting aperture wall to secure said bag and said lip being disposed below the surface of said base.

10. The scrap retainer of claim 9, wherein said base further includes an underside having a compressible pad attached thereto, said pad being compressible upon the placement of a load on said base, said perimeter wall limiting the compression of said pad.

11. The scrap retainer of claim 9, wherein said bag end terminates below the flange lip.

* * * * *